US006000807A

United States Patent [19]

Moreland

[11] Patent Number: 6,000,807

[45] Date of Patent: Dec. 14, 1999

[54] SWITCH COVER PLATE PROVIDING AUTOMATIC EMERGENCY LIGHTING

[76] Inventor: Gregory B. Moreland, 9932 Noble Ave., Mission Hills, Calif. 91345

[21] Appl. No.: 09/032,371

[22] Filed: Feb. 27, 1998

Related U.S. Application Data

[63] Continuation of application No. 08/846,041, Apr. 25, 1997, Pat. No. 5,833,350.

[51] Int. Cl.[6] ..... F21V 23/04; H05B 37/04

[52] U.S. Cl. ..... 362/95; 362/20; 362/85; 362/234; 307/66; 315/86

[58] Field of Search ..... 362/20, 85, 95, 362/276, 802, 234; 340/815.62; 307/66; 315/76, 86, 87; 200/312, 317

[56] References Cited

U.S. PATENT DOCUMENTS

| | | | |
|---|---|---|---|
| 2,863,038 | 12/1958 | Lombardo | 362/20 |
| 3,739,226 | 6/1973 | Seiter et al. | 362/20 |
| 4,177,500 | 12/1979 | Nichdl et al. | 362/20 |
| 4,461,974 | 7/1984 | Chiu | 315/65 |
| 4,514,789 | 4/1985 | Jester | 362/95 |
| 4,631,649 | 12/1986 | McCue et al. | 362/183 |
| 4,977,351 | 12/1990 | Bavaro et al. | 315/87 |
| 5,132,596 | 7/1992 | Walters et al. | 315/159 |
| 5,336,977 | 8/1994 | Li | 315/159 |
| 5,473,517 | 12/1995 | Blackman | 362/95 |

*Primary Examiner*—Alan Cariaso

*Attorney, Agent, or Firm*—Gene Scott - Patent Law & Venture GP.

[57] ABSTRACT

A wall mounted cover plate conceals an electrical circuit capable of sensing the field provided by a covered switch or electrical socket circuit. When power is lost at the wall circuit the electrical circuit senses the loss of power and activates one or more LEDs to provide emergency illumination. The electrical circuit is self contained and does not require stand-by energy so that the batteries are long lasting.

15 Claims, 3 Drawing Sheets

SWITCH COVER PLATE PROVIDING AUTOMATIC EMERGENCY LIGHTING

This application is a continuation of Ser. No. 08/846,041, filed Apr. 25, 1997, now U.S. Pat. No. 5,833,350.

BACKGROUND OF THE INVENTION

1. Field of the Invention

This invention relates generally to emergency lighting devices such as standby automatic lamps, and more particularly to such an emergency lighting device assembled into a common switch cover plate and providing an illumination source and a sensor for determining when AC power has been lost to the electrical switch covered by the plate.

2. Description of Related Art

The following art defines the present state of this field: Nicholl et al., U.S. Pat. No. 4,177,500 describes a power failure light for monitoring a power line and for illumination upon the interruption of power. This invention includes a light bulb, a rechargeable battery, a power supply providing charging current for the battery, a pair of diodes connecting the battery across the power supply, a pair of cascaded transistors connecting the bulb across the battery with base-emitter junctions Chiu, U.S. Pat. No. 4,461,974 describes a multiple lamp system for use with fiber optic light guide for automatically switching from a main lamp to a standby lamp, upon failure of the former. A solenoid is employed with the inductor in the circuit of the main lamp to overcome the bias of the switch in the standby lamp circuit to keep the former open. When the main lamp fails causing the interruption of current flow, the switch closes thereby permitting energization of the standby lamp. An indicator is provided to show which lamp is functioning.

Jester, U.S. Pat. No. 4,514,789 describes a light switch plate having a rearwardly opening housing for removably holding an AA battery. This invention is detachably mountable over a conventional wall mounted 110 volt AC light switch. An LED mounted on the front of the housing is connected to the battery through an integrated circuit oscillator, which flashes the LED.

McCue et al., U.S. Pat. No. 4,631,649 describes an emergency light fixture that is permanently mountable in a conventional power outlet box having, in fixed relation, a threaded bore for accommodating a screw for a face plate and slots for accommodating an electric plug. The emergency light fixture includes a housing, an electric plug extending from the rear wall of the housing, a battery, a battery charger, and a lamp mounted in the housing and wired to provide illumination during a power outage.

Bavaro et al., U.S. Pat. No. 4,977,351 describes an emergency lighting system which permits at least one gas discharge lamp to be operated from an AC power source when AC current is present and form a battery when AC signal is not present. The circuit also provides the capability for turning the lamp on under other selected emergency conditions such as in response to an intruder detection, or in response to detection of smoke, heat, water, or some other emergency.

Walters et al., U.S. Pat. No. 5,132,596 describes an outdoor lighting control that includes a photosensor responsive to ambient outdoor light and an alternating current relay with a pair of contacts movable between make and break positions. The relay includes a contact actuating arrangement that responds to the photosensor and alternating current bias the contact into a make position and move the contacts electromagnetically into a break position. The contact actuating arrangement is sufficiently stiff and responsive to the alternating current to limit chatter in the contact during passage from make to break to fifteen milliseconds when the photosensor senses a transition between dark and daylight. Preferably, the chatter is limited between 1 and 10 millseconds.

Li, U.S. Pat. No. 5,336,977 describes an emergency lighting device that includes a hollow casing, a magnetic field detecting unit, a lamp unit and a driving unit. The casing is positioned adjacent to an electric outlet. The magnetic field detecting unit is disposed inside the casing and detects the absence of a magnetic field from the electric outlet. The lamp unit is mounted operatively on the casing. The driving unit is disposed inside the casing and is connected electrically to the lamp unit and to the detecting unit. The driving unit includes a light-sensitive switch unit and is responsive to the detecting unit so as to activated the lamp unit only when the magnetic field from the electric outlet is absent and there is weak surrounding light.

Blackman, U.S. Pat. No. 5,473,517 describes a housing for an emergency light source, which is electrically connectable to a conventional light switch. The housing replaces a conventional switch plate and has at least one opening for receiving the switch plate and has at least one opening for receiving the switch actuator of the light switch. The replacement housing includes wires for electrical connection to the light switch and is divided into upper and lower housing section, wherein the upper section includes a battery compartment, a printed circuit board compartment, and an opening to receive the switch actuator. The lower housing section includes a compartment for receiving a compact fluorescent lamp, reflectors, and a diffuser cover.

The prior art teaches a variety of safety and emergency lighting devices. Blackman teaches a replacement switchplate with wired connection to a light switch. This switch plate contains a lighting means. Walters teaches a lighting control having photosensor responsive means. Jester teaches a lighted switch plate. Li teaches a magnetic field sensor responsive to an absence of power at a nearby AC outlet, such a sensor being unable to operate in conjunction with a switch since without current flow a magnetic field is not produced. However, the prior art does not teach a switch plate of compact size and proportions having field sensing capability so as to avoid the necessity of hard wiring and which provides an exit marker and illumination. The present invention fulfills these needs and provides further related advantages as described in the following summary.

SUMMARY OF THE INVENTION

The present invention teaches certain benefits in construction and use which give rise to the objectives described below.

The present invention provides a wall mounted plate which includes an electrical circuit capable of sensing the electrostatic field associated with an electrical circuit within, or behind the wall. The electrical circuit uses an antenna for sensing the loss of field energy and then enables a lighting circuit in order to provide emergency exit lighting.

A primary objective of the present invention is to provide a proximity circuit capable of providing emergency lighting when a power failure occurs, such circuit having advantages not taught by the prior art.

Another objective is provide such a circuit within a switch plate that is mounted over a switch box by the typical screw-on method used for common switch plates.

A further objective is to provide such a circuit which has the advantage of being operated over long periods of time by a small battery source and therefore does not require the use of household current.

A still further objective is to provide such a switch plate embodied in a relatively flat and compact size so as to give the appearance of an ordinary switch plate, yet which provides the advantages of emergency lighting and automatic functioning upon power failure.

A still further objective is to provide such a wall plate embodied in a relatively flat and compact size so as to give the appearance of an ordinary AC outlet cover, yet which provides the advantages of emergency lighting and automatic functioning upon power failure.

A still further objective is to provide such a wall plate embodied in a relatively flat and compact size so as to give the appearance of an ordinary wall cover plate, yet which provides the advantages of emergency lighting and automatic functioning upon power failure.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention an emergency lighting device generating illumination in closed spaces when a general power failure occures. A first embodiment of the invention, an emergency lighting device for covering a wall switch electrical box 10, which is mounted in or behind a wall 20 is illustrated in FIGS. 1–4. The electrical box 10 contains an electrical wall switch 30 having a switch arm 32 extending outwardly from the wall 20 so as to be manually adjusted for turning room lights on and off.

Figure 1:
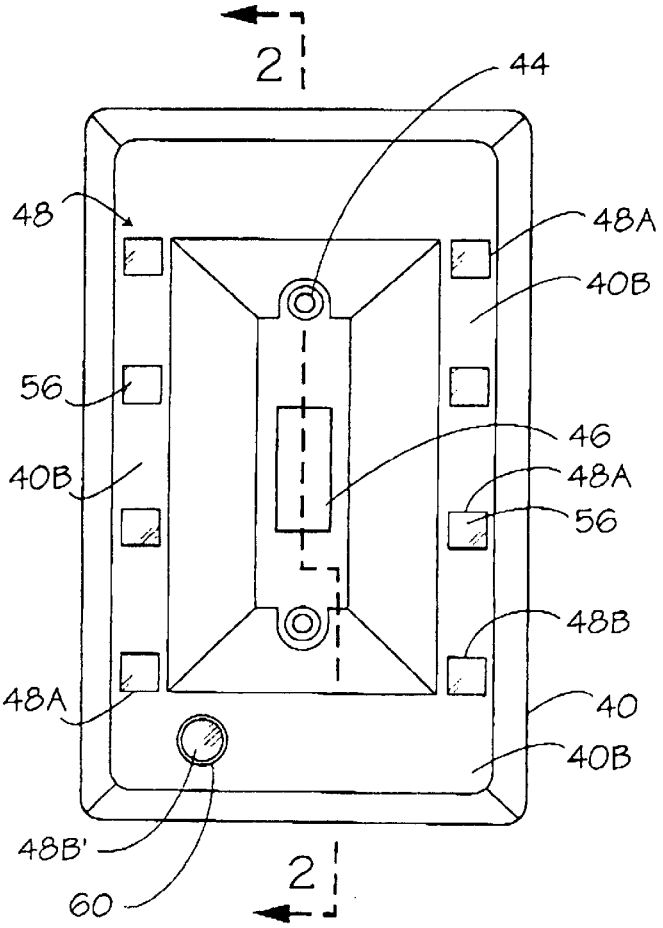
FIG. 1 is a front elevational view of a first embodiment of the present invention, a wall switch cover plate.
Figure 2:
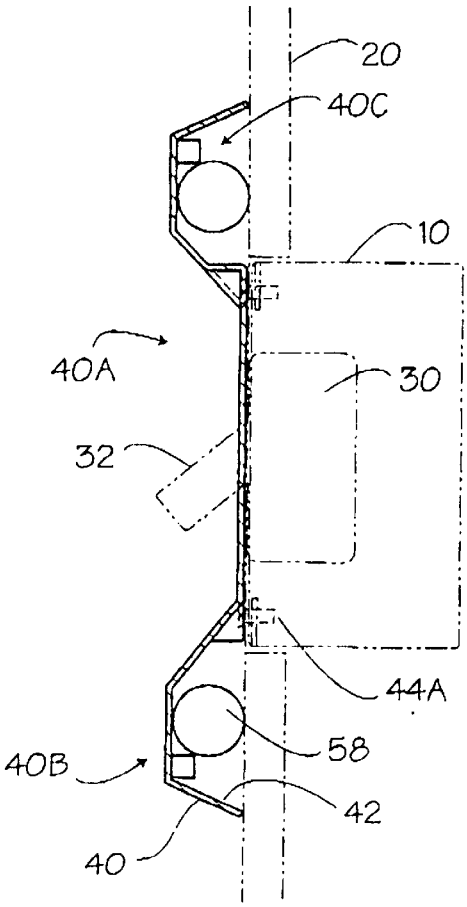
FIG. 2 is a sectional side elevational view thereof taken along cutting line 2—2 in FIG. 1 and showing a switch box and wall switch.
Figure 4:
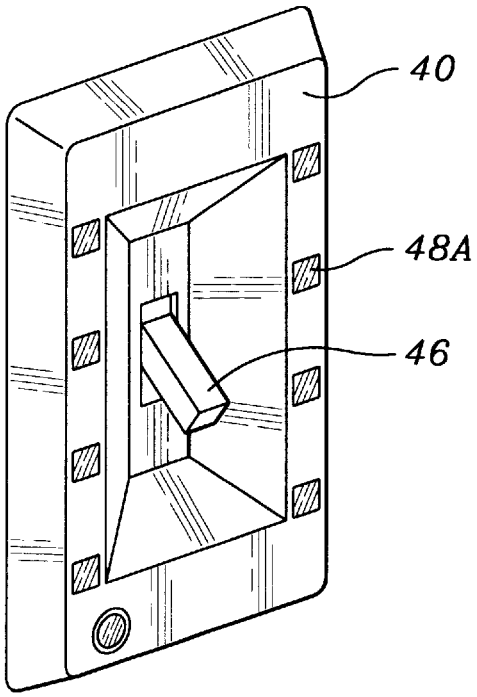
FIG. 4 is a perspective view of the embodiment of FIG. 1.
Figure 5:
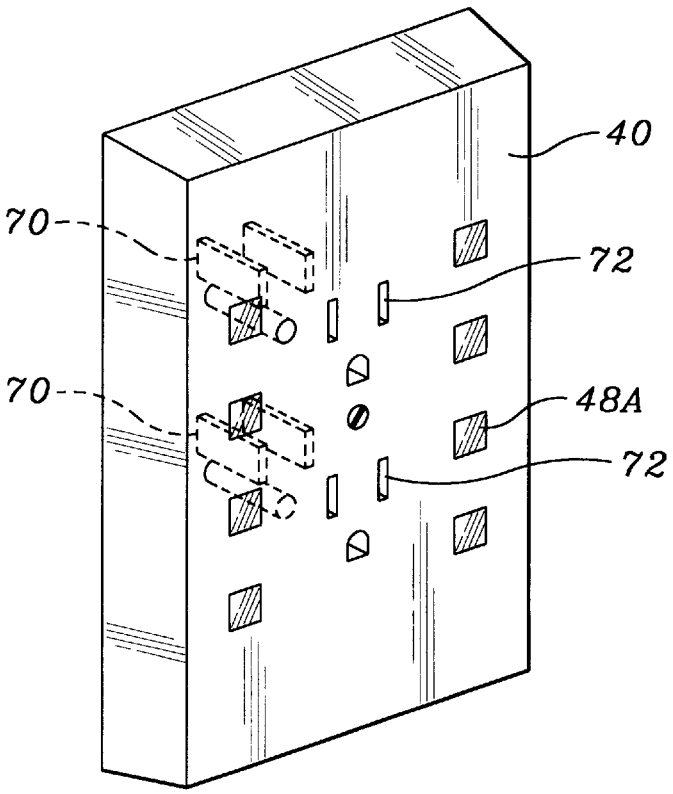
FIG. 5 is a perspective view of a second embodiment of the invention, a power outlet cover plate.

The invention includes a switch plate 40, one version of which is illustrated in FIGS. 1, 2 and 4, for covering the wall switch electrical box 10, the switch plate providing an electrical circuit mounting surface 42, a switch plate mounting means 44, typically a pair of spaced apart holes, and a switch arm engaging means 46, typically a rectangular hole. Preferably, the switch plate 40 provides a central portion 40A including the switch plate mounting means 44 and the switch arm engaging means 46. The central portion 40A is preferably planar, so as to lie in contact with the wall surface. The switch plate 40 further includes a peripheral portion 40B providing an enclosure means 40C for enclosing an electrical circuit 50. The enclosure means 40C provides a space for containing the components of the electrical circuit 50. This space is enclosed between the wall 20 and the switch plate 40 so that the electrical circuit components and their supporting elements are not visible from the front of the switch plate 40. The central portion 40A cooperates with the wall switch 30, and the peripheral portion 40B cooperates with the central portion and the surrounding wall to enclose the electrical circuit 50. This is considered a key inventive aspect of the present invention in that the device, as a whole takes on the appearance of a simple, common wall switch cover, and provides, a close-to-the wall portion (40A) for engaging the switch arm 32 (also commonly refered to as a "bat" or "toggle"), and a peripheral enclosure portion (40B) providing a means for circuit housing within the electrostatic filed of the wall switch, or as described below, any other electrostatic field generating electrical device.

Figure 3:
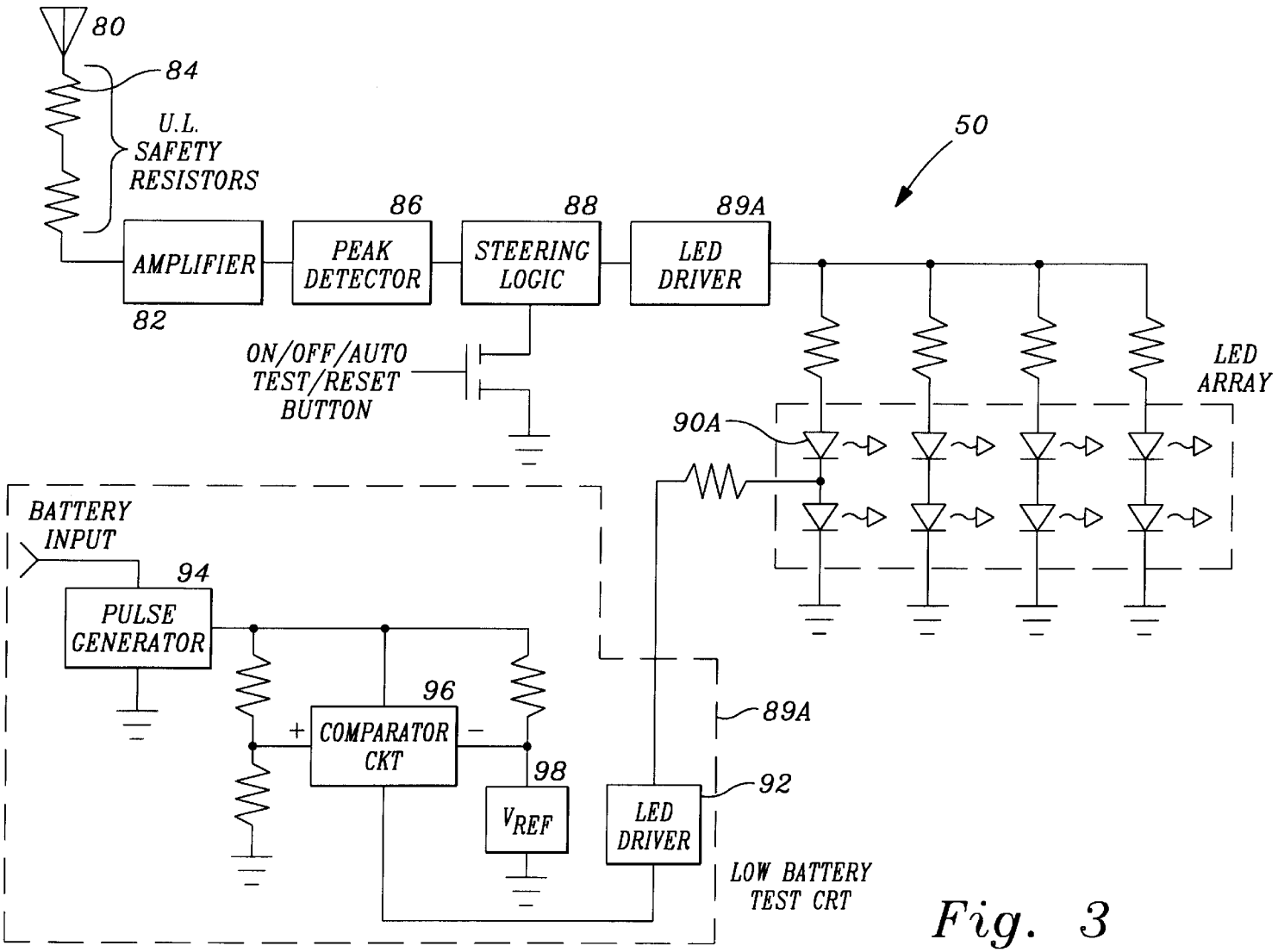
FIG. 3 is a block diagram of an electrical circuit of the invention.

The electrical circuit 50, is illustrated in FIG. 3. In this circuit, an antenna 80 is exposed to the local electrostatic field produced by the building AC wiring or other electrostatic field generating means such as the wall switch 30. The combination of electrostatic field strength, the coupling capacitance created by the antenna 80, the ground return, and the input impedance of an amplifier 82 all determine the level of signal voltage developed by the antenna 80. U. L. safety requirements demand that two large value safety resistors 84 be inserted in series with the antenna 80 to limit current flow should an electrical short occur between the antenna 80 and the building AC power wiring. Since, in the present invention there is no way for these two elements to come into contact, this occurance would be unlikely.

The amplifier 80 boosts the detected signal voltage for driving a peak detector circuit 86 and a steering logic circuit 88 as shown in FIG. 3. The peak detector circuit 86 produces a DC voltage which is proportional to the amplified antenna voltage once it exceeds a first threshold. Beyond a second threshold the peak detector circuit 86 saturates, providing no additional DC voltage boost although the AC field strength may increase further. Rapid charge and slow discharge characteristics are appropriately selected to avoid both false triggering of a bank of LED's 90 and any unnecessary delay in operation.

The steering logic circuit 88 accepts inputs from both the peak detector circuit 86 and a test/reset means 87, described herein also as a button. Both inputs are condtioned in the steering logic circuit 88 by schmiddt triggers to produce clean logic transitions. The steering logic circuit 88 makes decisions about whether the LED's 90 will be on or off depending on the following conditions, where it is understood that AC power is considered equivalent to the presence of the above described electrostatic field and loss of AC power is equivalent to the loss of the electrostatic field:

1) With AC power present with sufficient field strength the LED's 90 will be held off. Momentary activation of the test/reset button 87 will in turn momentarily activate the LED's 90. When the test/reset button 87 is released the LED's 90 automatically turn back off to avoid accidental and unnecessary draining of a battery 58 (see FIG. 2).
2) With AC power suddenly vanishing the LED's 90 will be latched in the on state until one of three things occurs:
   a) The battery 58 is discharged to an unuseable level.
   b) AC power is restored.
   c) The test/reset button 87 is momentarily pushed to reset the LED's 90 to an off state.

Subsequent cycling of the test/reset button 87 with AC power not present will cause alternate latching 'ON' and unlatching 'OFF' of the LED's 90. An LED driver circuit 89 senses the logic level produced by the steering logic circuit 88 and provides suffient current to drive the LED's 90 when it is commanded to do so. The LED's 90 are preferably super high flux types which can provide adequate lighting in a small room during AC power emergency conditions to facilitate personnel orientation. The test/reset means 87 and the steering logic circuit 88 is adapted for automatically placing the invention in an active state following a loss of the electrostatic field of the electrostatic field generating means (wall switch, etc.) and a manual shutdown of the illumination means 56, such that a subsequent return of the electrostatic field and a subsequent second loss of the electrostatic field provides a further ignition of the illumination means 56 without human intervention.

A low battery test circuit 92 senses when the battery 58 is discharged below a level that is necessary for providing sustained emergency lighting. It then flashes one of the LED's 90A with a repeated low duty cycle pulse to provide a visual warning. The low battery test circuit 92 is designed to test the battery 58 while minimizing battery current drain during the test. A pulse generator circuit 94 operates at a very low duty cycle providing battery power to a comparator circuit 96. Both the comparator circuit 96 and a voltage reference circuit 98 are momentarily turned on during each cycle of the pulse generator circuit 94. A sample of the battery voltage is compared to the voltage reference of the voltage reference circuit 98. The comparator circuit 96 then momentarily fires the LED driver 89B if the sampled battery voltage is too low. It should be clear from the description of the operation of each of the individual circuit elements described above that one of skill in the electrical engineering art will know how to build and operate each of these circuit elements. The purpose of the above circuit description and FIG. 3 is merely for enablement of the present invention and to identify how such well-known elements may be assembled and interconnected to make a working device capable of achieving the objectives of the present invention.

The switch plate 40 further provides an illumination means viewing means 48. The illumination means viewing means 48 may include at least one aperture 48A in the switch plate 40, the aperture(s) 48A being positioned and engaged with the illumination means 56 for direct viewing of the illumination means 56. Therefore, as shown in FIG. 1, aperture 48A is one or more rectangular holes in switch plate 40 through which elements of illumination means 56 may protrude or be visible. Alternately, the illumination means viewing means 48 may include at least one light transmissive portion 48B on the switch plate 40, where, the at least one light transmissive portion 48B is positioned and engaged with at least one element of the illumination means 56 for indirect viewing of the illumination means 56, i.e., by viewing the light from the illumination means 56 without viewing the illumination means 56 itself. Such an alternate viewing means 48B may be a clear or a colored portion of switch plate 40 which, as shown in FIG. 1 may lay over an illumination element part of illumination means 56.

In a second embodiment of the invention, as shown in FIG. 6, the electrical apparatus covered by the switch plate is an electical outlet means such as a duplex socket of the type well known in most households (not shown). Such a device has an electrical socket means accessable to the invention. In this case the electrical box engaging means is an electrical plug means 70, such as the dual plugs shown in the figure, for engaging the electrical socket means of the electrical apparatus. Therefore in this embodiment, the invention is mounted over a wall outlet box and is in close proximity thereto. Further the invention, in this embodiment provides a duplex socket 72 for accepting plugs that would otherwise be inserted into the socket of the electrical outlet means. This embodiment shows that the present invention may be used with an electical socket outlet as well as a wall switch for the same intended purpose. Obviously, the present invention may be applied to other applications beside wall switches and AC outlets. Any situation wherein an AC voltage change is occuring, with, or without current flow, within a few centimeters of the surface of a wall is appropriate for the mounting of the present invention onto the exterior wall surface in order to indicate that the AC voltage is no longer present and to provide emergency illumination. One important application is in the interior of elevators in order to provide emergency lighting in case of a power failure. It is clear that in many applications of the present invention no physical or electrical interconnection between the invention and the AC device or wiring that is being monitored by the invention is necessary. In such cases, the enclosure means 40 may be a smooth plate with mounting means. Such mounting means may be an adhesive backing or a magnet or other well known possibilities.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An emergency lighting device for placement on a wall adjacent to an electrostatic field of an electrostatic field generating means, the device comprising:

a wall plate adapted for mounting onto the wall in proximity to the electrostatic field generating means, the wall plate enclosing an electrical circuit means;

the electrical circuit means comprising a varying electrostatic field sensing means, an emergency switching means, an illumination means and a power source means, the electrical circuit being covered from view by the wall plate;

the wall plate engaging the illumination means;

the emergency switching means interconnecting the power source means with the illumination means when the field sensing means fails to sense the electrostatic field so as to provide emergency illumination when power is lost at the electrostatic field generating means;

a reset means adapted for automatically placing the electrical circuit means in an active state following a loss of the electrostatic field of the electrostatic field generating means and a manual shutdown of the illumination means, such that a subsequent return of the electrostatic field and a second loss of the electrostatic field provides a further ignition of the illumination means.

2. The device of claim 1 wherein the electrostatic field generating means is a wall switch having a switching means extending outwardly therefrom, and the wall plate providing an aperture for receiving the power switching means of the electrostatic field generating means.

3. The device of claim 2 wherein the wall plate includes at least one open portion positioned and engaged with the illumination means for direct viewing of the illumination means.

4. The device of claim 2 wherein the wall plate includes at least one light transmissive portion positioned and engaged with the illumination means for indirect viewing of the illumination means.

5. The device of claim 2 wherein the wall plate provides a central portion including the aperture, and a peripheral portion, around the aperture, for enclosing the electrical circuit means.

6. The device of claim 2 further including a test switch interconnected with the electrical circuit for testing the circuit by manual actuation thereof.

7. The device of claim 2 further including a low-battery sensor interconnected with the electrical circuit for sensing a low battery condition and for actuating the illumination means for indicating a low battery condition.

8. The device of claim 2 wherein the electrostatic field sensing means is an antenna, the emergency switching means is a transistor driven by an amplified signal provided by the antenna, the illumination means is a plurality of LED devices, and the power source means is a battery.

9. The device of claim 1 wherein the electrostatic field generating means is an electrical outlet means having an electrical socket means accessable thereto, and the electrostatic field generating means engaging means is an electrical plug means adapted for engaging the electrical socket means of the electrical outlet means.

10. The device of claim 9 wherein the wall plate includes at least one open portion positioned and engaged with the illumination means for direct viewing of the illumination means.

11. The device of claim 9 wherein the wall plate includes at least one light transmissive portion positioned and engaged with the illumination means for indirect viewing of the illumination means.

12. The device of claim 9 wherein the wall plate provides a central portion including the switching means engaging means, and a peripheral portion for enclosing the electrical circuit means.

13. The device of claim 9 further including a test switch interconnected with the electrical circuit for testing the circuit by manual actuation thereof.

14. The device of claim 9 further including a low-battery sensor interconnected with the electrical circuit for sensing a low battery condition and for actuating the illumination means for indicating a low battery condition.

15. The device of claim 9 wherein the electrostatic field sensing means is an antenna, the emergency switching means is a transistor driven by an amplified signal provided by the antenna, the illumination means is a plurality of LED devices, and the power source means is a battery.

* * * * *

UNITED STATES PATENT AND TRADEMARK OFFICE

CERTIFICATE OF CORRECTION

PATENT NO. : 6,000,807
DATED : December 14, 1999
INVENTOR(S) : Gregory B. Moreland It is certified that error appears in the above-identified patent and that said Letters Patent is hereby corrected as shown below:

Title page,
Item [63],
Continuation of application No. 08/846,041 Apr. 25, 1997, Pat. No. 5,833,350, should be deleted.

Signed and Sealed this

Fifth Day of March, 2002

*Attest:*

*Attesting Officer*

JAMES E. ROGAN
*Director of the United States Patent and Trademark Office*